US006523433B1

(12) United States Patent
Staker

(10) Patent No.: US 6,523,433 B1
(45) Date of Patent: Feb. 25, 2003

(54) ELECTRONIC PEDAL ASSEMBLY AND METHOD FOR PROVIDING A TUNEABLE HYSTERESIS FORCE

(76) Inventor: William C. Staker, 17513 N. Fruitport Rd., Spring Lake, MI (US) 49456

( * ) Notice: Subject to any disclaimer, the term of this patent is extended or adjusted under 35 U.S.C. 154(b) by 0 days.

(21) Appl. No.: 09/717,599

(22) Filed: Nov. 21, 2000

Related U.S. Application Data

(60) Provisional application No. 60/167,034, filed on Nov. 23, 1999.

(51) Int. Cl.[7] ..... G05G 1/14
(52) U.S. Cl. ..... 74/513; 74/560
(58) Field of Search ..... 74/512, 513, 514, 74/560; 188/83

(56) References Cited

U.S. PATENT DOCUMENTS

| | | | |
|---|---|---|---|
| 3,643,524 A | | 2/1972 | Herring |
| 3,643,525 A | | 2/1972 | Gibas |
| 3,691,868 A | | 9/1972 | Smith |
| 3,754,480 A | | 8/1973 | Bodnar et al. |
| 3,869,279 A | | 3/1975 | Grimes et al. |
| 3,975,972 A | | 8/1976 | Muhleck |
| 4,445,603 A | | 5/1984 | Filsinger |
| 4,683,977 A | | 8/1987 | Salmon |
| 4,695,819 A | | 9/1987 | Bowsher |
| 4,819,500 A | | 4/1989 | Musumiya et al. |
| 4,869,220 A | | 9/1989 | Imoehl |
| 4,870,871 A | | 10/1989 | Ivan |
| 4,875,385 A | | 10/1989 | Sitrin |
| 4,944,269 A | | 7/1990 | Imoehl |
| 4,958,607 A | | 9/1990 | Lundberg |
| 4,976,166 A | * | 12/1990 | Davis et al. ..... 74/512 |
| 4,989,474 A | | 2/1991 | Cicotte et al. |
| 5,010,782 A | | 4/1991 | Asano et al. |
| 5,033,431 A | | 7/1991 | Poirier et al. |
| 5,078,024 A | | 1/1992 | Cicotte et al. |
| 5,086,663 A | | 2/1992 | Asano et al. |
| 5,172,606 A | | 12/1992 | Dzioba et al. |
| RE34,302 E | | 7/1993 | Imoehl |
| RE34,574 E | | 4/1994 | Imoehl |
| 5,321,980 A | | 6/1994 | Hering et al. |

(List continued on next page.)

FOREIGN PATENT DOCUMENTS

| | | |
|---|---|---|
| DE | 40 37 493 A1 | 6/1991 |
| DE | 19 503 335 A1 | 12/1995 |
| DE | 19 536 605 A1 | 4/1997 |
| DE | 195 36 605 A1 | 4/1997 |
| EP | 0 355 967 | 2/1990 |
| EP | 1 155 909 A1 | 11/2001 |
| JP | 9-52541 | 2/1997 |
| WO | WO98/14857 | 4/1998 |
| WO | 02/08009 A1 | 1/2002 |

*Primary Examiner*—Jack Lavinder
*Assistant Examiner*—Robert A. Siconolfi
(74) *Attorney, Agent, or Firm*—Allen, Dyer, Doppelt, Milbrath & Gilchrist, P.A.

(57) ABSTRACT

An electronic throttle control pedal pivotally couples a lever arm to a pedal beam and biases the beam for resisting an applying force to the pedal beam and for biasing sliding surfaces together in frictional contact. A compression spring carried between a mounting bracket and the lever arm biases the pedal beam toward an idle position while at the same time causing a frictional force between the frictional surfaces, such that displacing the pedal beam with an applying force compresses the spring which increases a frictional force between the friction surfaces with an increasing displacement of the pedal beam distal end, and reducing the displacement through a retracting force on the pedal beam distal end expands the compression spring and returns the pedal beam to the idle position through a hysteresis force response for the pedal beam displacement. The hysteresis can be tuned by modifying element dimensions of the pedal.

27 Claims, 4 Drawing Sheets

U.S. PATENT DOCUMENTS 5,351,573 A 10/1994 Cicotte
5,385,068 A 1/1995 White et al.
5,408,899 A 4/1995 Stewart
5,416,295 A 5/1995 White et al.
5,445,125 A 8/1995 Allen
5,460,061 A 10/1995 Redding et al.
5,461,939 A 10/1995 Upton
5,524,589 A 6/1996 Kikkawa et al.
5,529,296 A 6/1996 Kato et al.
5,602,732 A 2/1997 Nichols et al.
5,632,183 A 5/1997 Rixon et al.
5,661,890 A 9/1997 Pfaffenberger
5,673,668 A 10/1997 Pallett et al.
5,676,220 A 10/1997 Dapsi et al.
5,697,260 A 12/1997 Rixon et al.
5,713,189 A 2/1998 Toman
5,749,343 A 5/1998 Nichols et al.
5,768,946 A 6/1998 Fromer et al.
5,894,762 A 4/1999 Arao et al.
5,905,198 A 5/1999 Pfaffenberger
5,912,538 A 6/1999 Turner
5,934,152 A * 8/1999 Aschoff et al. ..... 74/512
5,937,707 A * 8/1999 Rixon et al. ..... 74/512
5,950,597 A 9/1999 Kamio et al.
5,976,056 A 11/1999 Matsumoto et al.
5,996,438 A 12/1999 Elton
6,003,404 A * 12/1999 Hannewald ..... 74/512
6,006,722 A 12/1999 Hall
6,017,290 A 1/2000 Kinoshita et al.
6,023,995 A 2/2000 Riggle
6,029,510 A 2/2000 Nakaie et al.
6,030,316 A 2/2000 Kadota
6,047,679 A 4/2000 Matsumoto et al.
6,070,490 A * 6/2000 Aschoff et al. ..... 74/513
6,070,852 A 6/2000 McDonnell et al.
6,073,610 A 6/2000 Matsumoto et al.
6,089,120 A 7/2000 Lochle et al.
6,095,488 A 8/2000 Semeyn, Jr. et al.
6,098,971 A * 8/2000 Stege et al. ..... 267/216
6,104,976 A 8/2000 Nakamura
6,105,737 A 8/2000 Weigert et al.
6,109,241 A * 8/2000 Engelgau ..... 123/399
6,158,299 A 12/2000 Czajkowski
6,186,025 B1 * 2/2001 Engelgau et al. ..... 74/512
6,220,222 B1 4/2001 Kalsi
6,289,762 B1 * 9/2001 Silva ..... 74/513
6,295,891 B1 * 10/2001 Velte et al. ..... 74/513
6,298,748 B1 * 10/2001 Rixon et al. ..... 74/512
6,318,208 B1 11/2001 Thongs, Jr. et al.
6,330,838 B1 12/2001 Kalsi

* cited by examiner

ELECTRONIC PEDAL ASSEMBLY AND METHOD FOR PROVIDING A TUNEABLE HYSTERESIS FORCE

CROSS REFERENCE TO RELATED APPLICATION

This application incorporates by reference and claims priority to related Provisional Application Ser. No. 60/167,034 for "ETC Pedal Hysteresis Device" having a filing date of Nov. 23, 1999, and commonly owned with the instant application.

FIELD OF THE INVENTION

The present invention relates to pedal assemblies in particular to a pedal for vehicle engines employing electronic throttle control systems, wherein the pedal provides a hysteresis force to simulate a mechanical feel to the pedal during operation by a driver of the vehicle.

BACKGROUND OF THE INVENTION

Electronic controls and computers are well known in the art of automotive manufacturing. It is not unusual for a late model automobile to have a computer for monitoring and controlling many of its operating systems. Typically an input stage may include data collection by sensors. The collected data is input to a processing stage where an electronic control module interprets the data and calculates appropriate output for delivery to an output stage. Actuators within the output stage convert the appropriate output to a desired physical movement. One such operating system includes the electronic throttle control (ETC). In the ETC system, often referred to as a "drive-by-wire" system, the accelerator pedal is not connected to the throttle body by a cable, as in earlier model vehicles, but rather by an electrical connection between the pedal and a throttle controller, as described by way of example in U.S. Pat. Nos. 5,524,589 and 6,073,610. As described by way of example with reference to U.S. Pat. No. 6,098,971, a potentiometer typically replaces the cable that normally runs to the throttle body and electrical wires send pedal position information to a computer. As a result, the pedal must now have its own springs. However, it is desirable to simulate the mechanical feel of a conventional pedal. With each spring having its own feel and no hysteresis effect as does a cable in a sheath, a spring and mechanical hysteresis device is desirable for operation with the pedal for simulating the mechanical feel. A hysteresis force is a controlled frictional force which simulates the friction created in a conventional pedal as the linkage cable is pushed and pulled through a cable sheath. The hysteresis forces have the beneficial effect to a driver, by way of example, of preventing fatigue, as the force needed to maintain a fixed position of the pedal is less than the force to move the pedal to the fixed position. In addition, the hysteresis force helps enable the vehicle operator to maintain a fixed pedal position over bumpy roads.

A pedal position sensor provides an electrical voltage output responsive to pedal angular position. The pedal position sensor typically includes a resistive potentiometer which replaces the cable that normally runs to the throttle body of the vehicle engine. As described in U.S. Pat. No. 6,098,971 to Stege et al., and as is well known in the industry, problems inherent with drive-by-wire systems include the need for the pedal to have its own spring, and with its own spring, the feel of the pedal can change from pedal to pedal and manufacturer to manufacturer. To provide a desirable feel, pedals used with electronic controls have included hysteresis devices that provide varying friction during depressing and releasing of the pedal. Typically, and as further described in U.S. Pat. No. 6,098,971, a pedal module for use with ETC systems includes return springs operable with hysteresis elements that provide a varying force against the pedal when being operated between an idle position and an accelerating control position, by way of example.

Various measures of hysteresis force are defined in vehicle manufacturer's specifications for ETC accelerator pedals. In some cases a constant hysteresis force is specified, but in others a hysteresis force which increases with applied pedal force is preferred. Also, the amount of hysteresis force as a percentage of applied force has generally increased as the specifications have become more refined. The need to provide a mechanism which produces a controllable, and "tuneable," hysteresis force of significant magnitude presents a challenge to the pedal designer.

With no hysteresis force the applied pedal force is balanced by the force from the return spring. The hysteresis force is a form of friction force which subtracts from the applied force as the pedal is being depressed and subtracts from the spring force as the pedal is being returned toward its idle position. Such friction force depends on a normal force being generated at a frictional surface. A number of arrangements of springs and friction pads, or washers are known. However, there remains a need for a low cost pedal that is simple to fabricate using plastic molding technology and can be tuned to a broad range of customer requirements.

SUMMARY OF THE INVENTION

In view of the foregoing background, it is therefore an object of the present invention to provide a pedal operable with an electronic throttle controller that can be easily and effectively modified to meet varying hysteresis requirements. It is further an object of the present invention to provide a reliable yet inexpensive hysteresis effect for a pedal.

These and other objects, advantages and features of the present invention are provided by a pedal having a base and a pedal beam rotatably connected to the base. An arm member is pivotally coupled to the pedal beam and includes a friction surface that slidably engages a surface of the base for movement on the surface during rotation of the pedal beam. In one preferred embodiment, a compression spring provides means for biasing the pedal beam and arm member toward a preselected position through a biasing force on the arm member, while simultaneously biasing the friction surface of the arm member against the surface of the base, wherein rotating the pedal beam with an applying force to a free end thereof results in a frictional force between the arm member and the base with an increasing displacement of a pedal free end. Further, reducing the displacement through a retracting force returns the pedal to the preselected position through a hysteresis force response for the pedal beam displacement, wherein the retracting force is less than the applying force by a predetermined amount for a preselected displacement.

A method aspect of the invention provides a preselected hysteresis force response during displacement of a pedal. The pedal includes the pedal beam pivotally connected to the base for rotation about a shaft carried by the base. The method includes pivotally coupling an arm member to the pedal beam. The arm member has a friction surface positioned for engaging a surface of the base for slidable movement thereon. The pedal beam is biased toward a preselected position through a biasing force on the arm member, while simultaneously biasing the friction surface of the arm member against the surface of the base. As a result, rotating the pedal beam with an applying force to a free end of the pedal beam creates a frictional force between the arm member and the base with an increasing displacement of a pedal free end. In addition, reducing the displacement through a retracting force returns the pedal to the preselected position through a hysteresis force response for the pedal beam displacement, wherein the retracting force is less than the applying force by a predetermined amount for a preselected displacement.

By providing the arm member with first and second arm portions of a preselected length dimensions, a preselected biasing of the friction surface of the arm member against the surface of the base can be achieved. In addition, with a longitudinal axis of the arm member extending through a pivot point thereof, and with the friction surface engaging the surface of the base along a friction plane axis oriented at a non-zero angle to the longitudinal axis of the arm member, orienting the friction plane axis at a preselected orientation provides an alternate method of providing desired frictional forces and thus a desired hysteresis. Yet another method includes modifying friction surface materials so as to change their coefficients of friction.

A method further includes sensing rotation of the pedal beam for providing an electrical signal representative of pedal rotation about the rotation axis and thus pedal pad displacement.

BRIEF DESCRIPTION OF THE DRAWINGS

A preferred embodiment of the invention, as well as alternate embodiments are described by way of example with reference to the accompanying drawings in which.

DETAILED DESCRIPTION OF PREFERRED EMBODIMENTS

Figure 1:
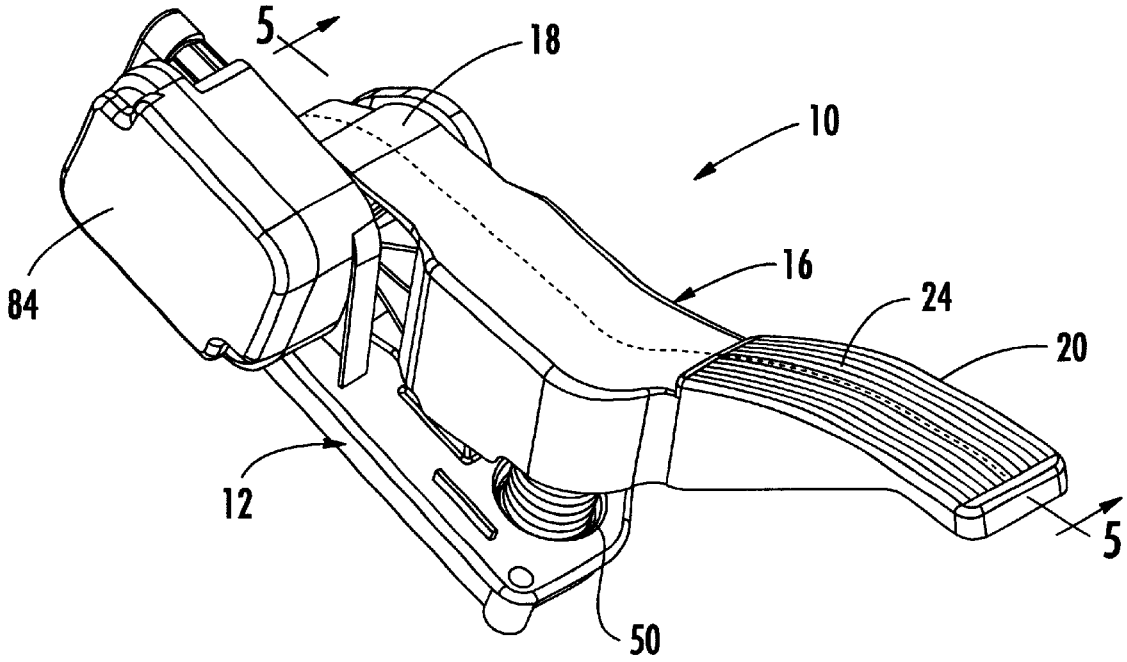
FIGS. 1 and 2 are perspective views of alternate embodiments of the present invention illustrating accelerator pedals operable with an electronic throttle control system.
Figure 2:
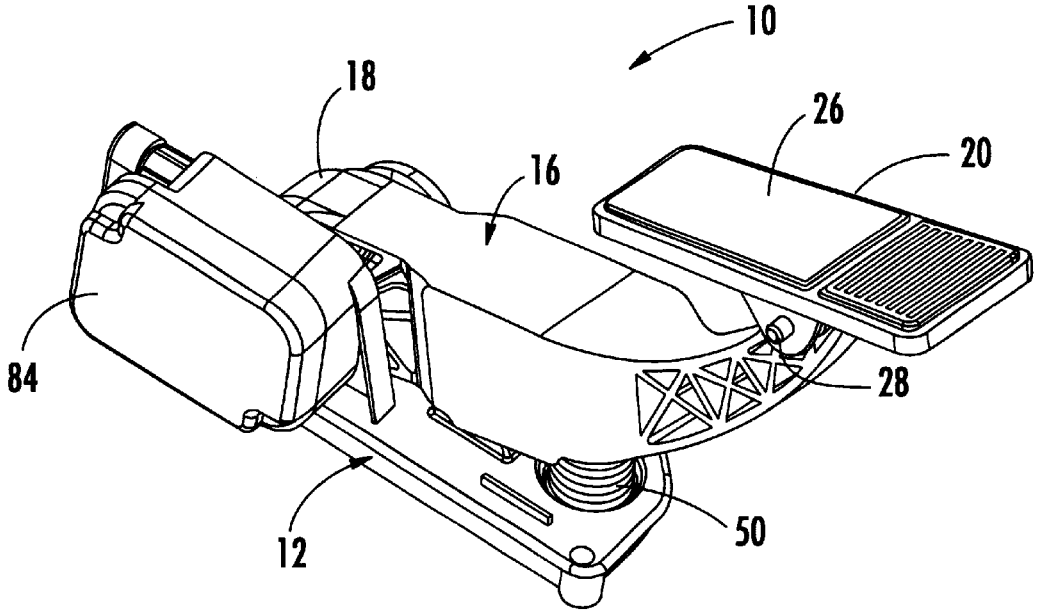

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

With reference initially to FIGS. 1–5, and as herein described by way of example, an embodiment of the present invention includes a pedal 10 useful for operation with a motor vehicle having an electronic throttle control system. The pedal 10 comprises a mounting bracket 12 forming a base for mounting the pedal to a vehicle wall. A shaft 14 is carried by the bracket 12 with a pedal beam 16 having a proximal end 18 rotatably connected to the shaft and a distal end operable by a user for applying a force to displace the pedal beam distal end and rotate the pedal beam about a rotation axis 22. As illustrated, by way of example, with reference again to FIGS. 1–4, the pedal beam distal end 20 may have a pedal pad 24 fixed to the distal end, alternatively, a pivotal pad 26 connected via a pivot pin 28 and coil spring 30, or yet other connection, without departing from the intent and teachings of the present invention.

Figure 3:
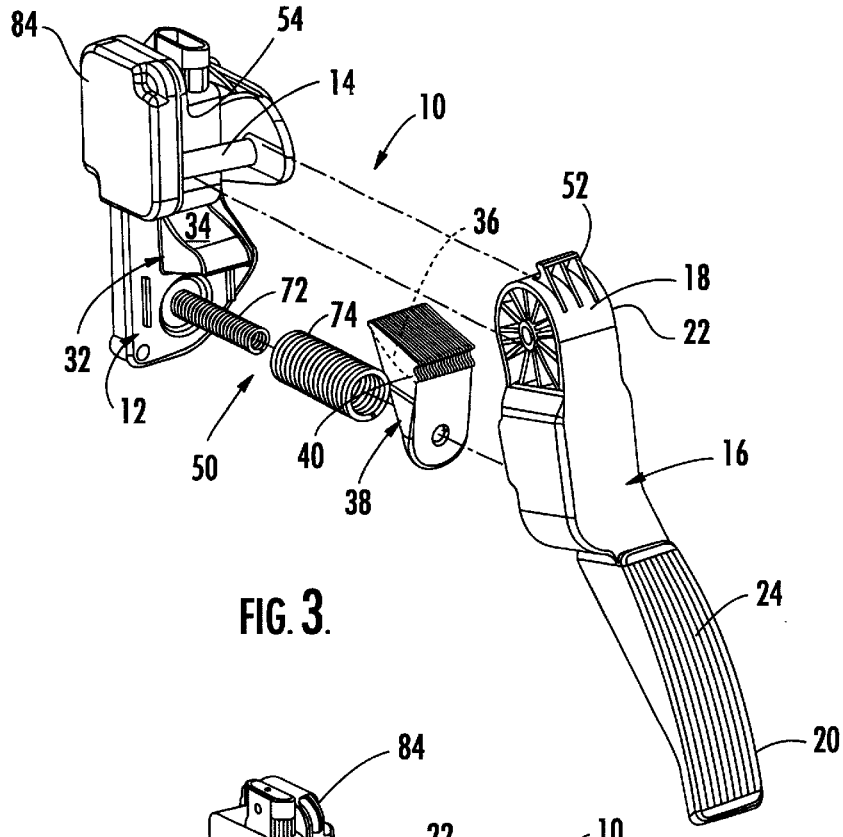
FIGS. 3 and 4 are exploded perspective views of the pedals of FIGS. 1 and 2, respectively.
Figure 4:
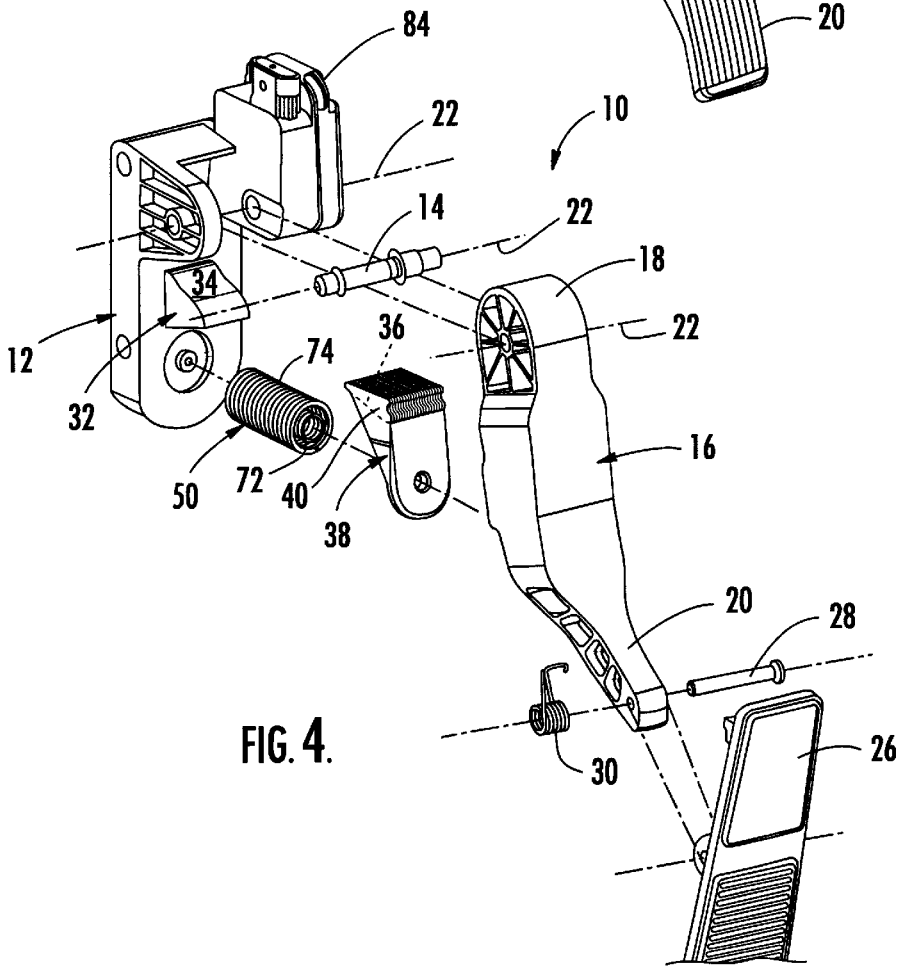
Figure 5:
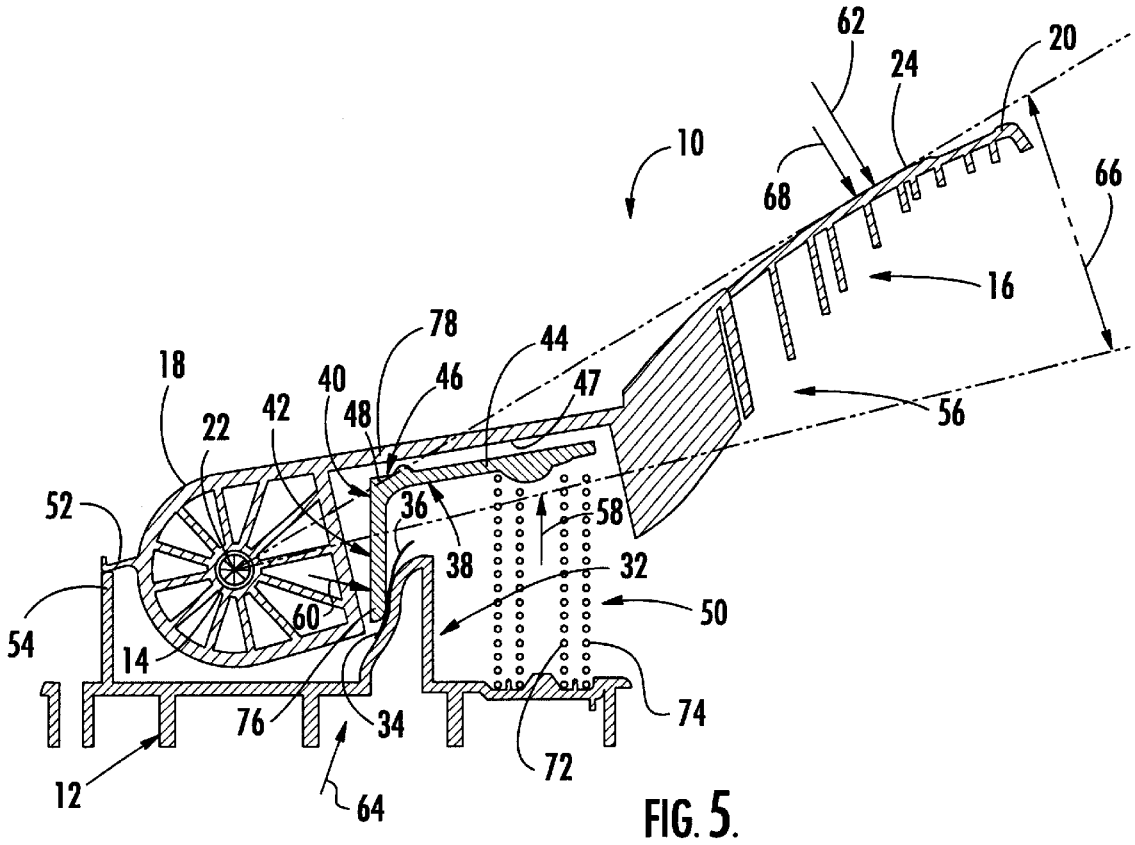
FIG. 5 is a partial cross-section view of the pedal of FIG. 1, taken through lines 5—5.

With continued reference to FIGS. 3 and 4, and to FIG. 5, a friction block 32 carried by the mounting bracket 12 includes a first friction surface 34 which is slidable with a second friction surface 36 on an a lever arm 38. Preferably, but not required, the first and second friction surfaces include arcuate surfaces, and in particular concave and convex, respectively. The lever arm 38 is pivotally coupled to the pedal beam 16 at a medial portion 40, with opposing first and second arm members 42, 44 pivotal about the medial portion. By way of example for one coupling arrangement, a boss 46 extends outwardly from an underside surface 47 of the pedal beam 16 and is pivotal within a depression 48 within the medial portion 40 for pivotally coupling the lever arm 38 to the pedal beam 16. The first arm member 42, as herein described by way of example with reference to FIG. 5, includes the second friction surface 36 which slidably engages the first friction surface 34 of the friction block 32.

With continued reference to FIGS. 3–5, a compression spring 50 provides a biasing of the pedal beam 16 away from the mounting bracket 12 by biasing the second arm member 44 away from the mounting bracket, which biasing causes the lever arm 38 to pivot about the boss 46 and cause the second friction surface 36 of the first arm member 42 to be biased against the first friction surface 34 on the friction block 32. A tab 52 carried on the proximal end 18 of the pedal beam 16 is driven against a stop 54 extending from the mounting bracket 12. The stop 54 is positioned for providing an idle pedal position 56 through a biasing spring force 58 on the lever arm 38, and further a biasing normal force 60 from the second friction surface 36 against the first friction surface 34.

Figure 6:
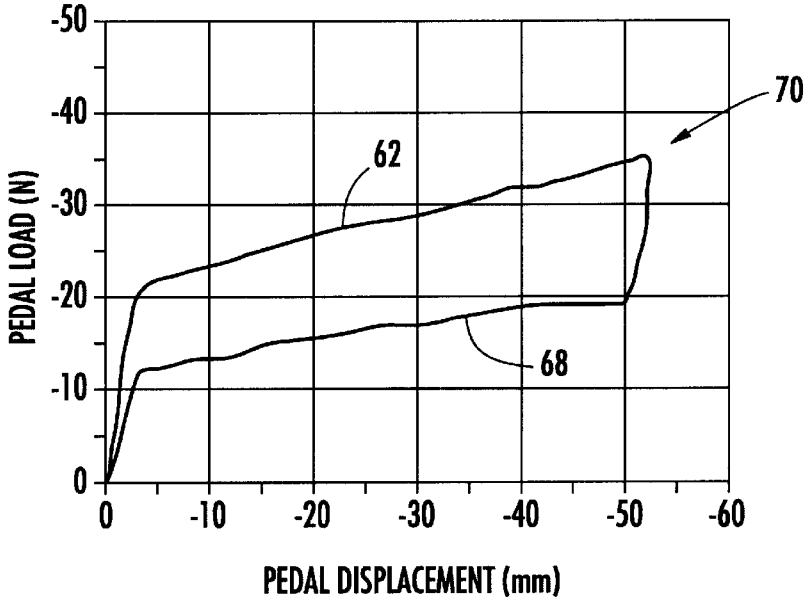
FIG. 6 is a graph of load on a pedal of FIG. 1 versus displacement of the pedal illustrating a desirable hysteresis effect.

With reference again to FIG. 5, by way of example, and to FIG. 6, displacing the pedal beam distal end 20 by applying an applying force 62 thereto compresses the compression spring 50 which increases the normal force 60, and thus a frictional force 64 between the first and second friction surfaces 34, 36 with an increasing displacement 66 of the pedal beam distal end. Further, reducing the displacement through a retracting force 68 on the pedal pad 24 expands the compression spring 50 and returns the pedal beam 12 to the idle position 56 through a hysteresis force response 70 for the pedal beam displacement 66. The retracting force 68 is desirably less than the applying force 62 for a given displacement.

With reference again to FIG. 5, one preferred embodiment of the present invention includes the first arm member 42 generally orthogonal to the second arm member 44. With such an arrangement, the medial portion 40 pivots with the pedal beam 16, the second arm member is operable with the compression spring 50 for rotating the first arm member about the medial portion and for biasing the second friction surface 36 against the first friction surface 34, without the first arm member contacting the underside 37 of the pedal beam 16. As illustrated with reference again to FIGS. 3–5, the compression spring 50 may include an inner compression spring 72 and an outer compression spring 74 as redundant biasing means or for enhancing the compression required to compress the spring, as desired. Alternatively, resilient material such as plastic or rubber may be used in place of the compression spring. By way of further example, a torsion spring may be used with a pinned pivot point without departing from the teaching of the present invention.

Figure 7:
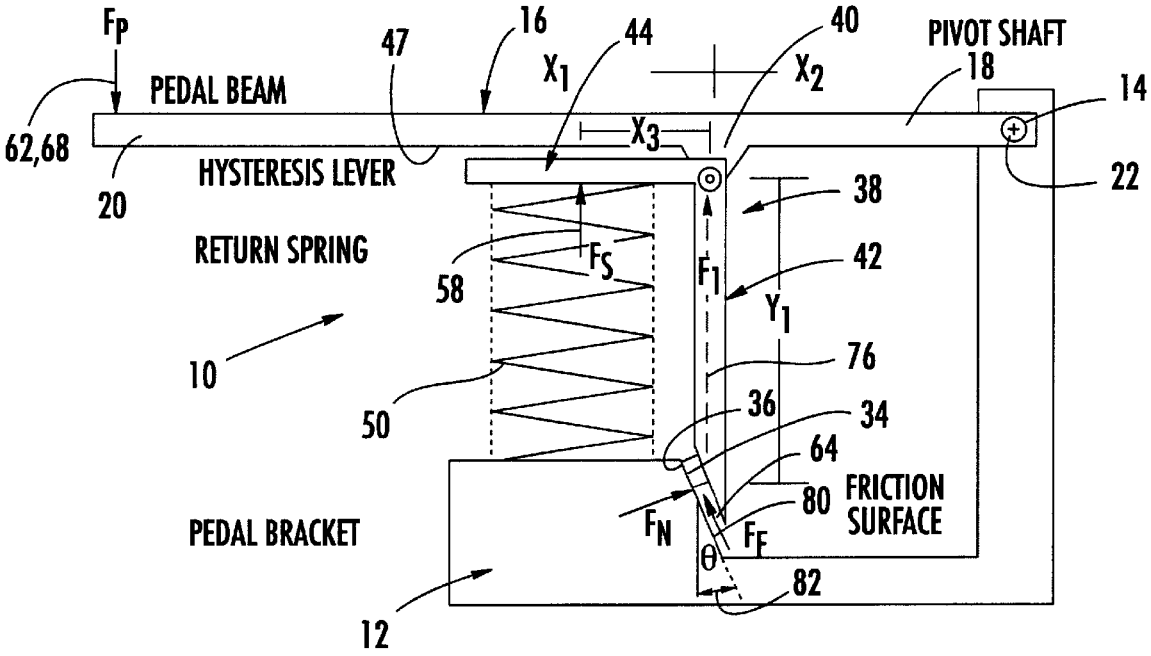
FIG. 7 is a geometric diagram, not to scale, illustrating forces acting on elements of a hysteresis device.

With reference again to FIGS. 5 and 7, and as earlier described, the first friction surface 34 comprises a concave surface and the second friction surface 36 comprises a convex surface. One embodiment of the present invention includes each of the convex and concave surfaces 34, 36 to be defined by a radius of curvature centered about the rotation axis 22 of the pedal beam 12. Further, with a longitudinal axis 76 of the first arm member 42 extending through a pivot point 78 thereof, and the second friction surface 36 engaging the first friction surface 34 along a friction plane axis 80 defining an orientation of the first and second friction surfaces at an angle 82 to the longitudinal axis as illustrated with referenced to FIG. 7 for a flat surface, changing the angle will affect the hysteresis response 70 and can be tuned, or modified as desired, as will be described in greater detail later in this section. By way of further example, the lengths of the first and second arm members 42, 44 can be modified for providing a preselected biasing of the first friction surface to the second friction surface. With reference to the preferred arcuate friction surface of FIG. 5, it should be noted that wear is reduced as a result of the increase in surface contact between the friction surfaces as the pedal is displaced and the normal force increases with the displacement.

With reference again to FIGS. 1–5, a position sensor 84 responsive to rotation of the pedal beam 12 about the shaft 14 provides an electrical signal representative of the rotation and thus the displacement 66 of the pedal.

By way of further example, the pedal 10 described earlier with reference to FIG. 5, by way of example, is shown in schematic form with reference to FIG. 13. Referring to such a schematic and including reference numerals as earlier presented, the pedal beam 16 rotates about the rotation axis 22 with the bracket 12 supporting the pedal beam. The compression spring 50 biases against the lever arm 38 and applies a force to the pedal beam through the lever arm such that the force is applied at the controlled pivot point. Such pivot point may be a pinned joint, or it may be a cylindrical rib interfacing with a mating feature in the pedal beam. As the pedal is depressed, the lever arm interferes with the pedal bracket at the friction surfaces. The normal force 60 is created by the spring operating through the geometry of the lever arm 38. The hysteresis force response 70, as earlier described with reference to FIG. 6, can be altered by the geometry of the lever arm and by the frictional characteristics of the materials that form the friction surfaces. This device uses only one pair of frictional surfaces, for both the down and up displacements of the pedal, to create the hysteresis force. The spring force 58 is the result of the enforced displacement of the spring due to the motion of the pedal beam as well as the motion of the friction link of the friction surfaces.

By way of example, it can be shown by analysis that the applied force 62 to the pedal beam by the hysteresis link can be expressed by:

$$F_{1y} = F_s + F_s \frac{x_3}{y_1}\left[\frac{\sin\theta + \mu\cos\theta}{\cos\theta - \mu\sin\theta}\right]$$

for the case in which the pedal is traveling downward.

To simplify, letting $\Theta=0$, $\Theta$ being angle 82, the force applied to the pedal beam is $$F_{1y} = F_s + F_s\mu\frac{x_3}{y_1}$$

The hysteresis force contribution to the force applied to the pedal beam is $$F_s\mu\frac{x_3}{y_1}$$

The hysteresis force can thus be tailored by the ratio $x_3/y_1$.

For the case in which the pedal travels upward, or moves in a direction so as to return to the idle position, the direction of the friction force changes so that the force applied to the pedal beam by the hysteresis link is $$F_{1y} = F_s + F_s \frac{x_3}{y_1}\left[\frac{\sin\theta - \mu\cos\theta}{\cos\theta + \mu\sin\theta}\right]$$

Figure 8:
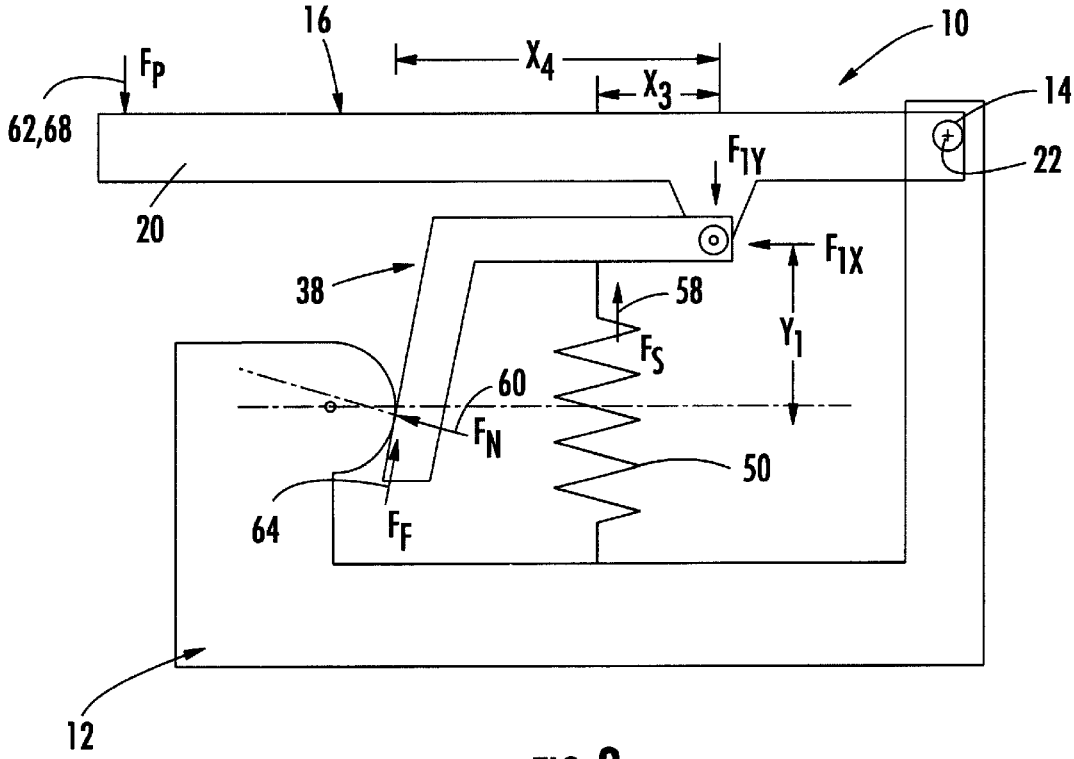
FIG. 8 is an alternate illustration of FIG. 7.

FIG. 8 shows an alternate embodiment of the concept. In this case the friction surface is located at a distance $x_4$ from the hysteresis pivot point. As before, the frictional surfaces of the hysteresis lever and pedal bracket can be contoured in order to maintain a controlled contact area as the pedal is depressed. For each configuration, the y-component of the normal force contributes to the composite vertical force $F_{1y}$ transmitted to the pedal beam. For the configuration in FIG. 7, the y-component of the normal force impedes downward pedal motion and aids upward motion. For the configuration of FIG. 8, the y-component of the normal force tends to impede motion in the upward direction.

For the configuration of FIG. 8, it can be shown that the force applied to the pedal beam by the hysteresis link, for the downward pedal travel direction, can be expressed by:

$$F_{1y} = F_s + \frac{F_s X_3(\sin\theta + \mu\cos\theta)}{y_1(\mu\sin\theta - \cos\theta) - x_4(\mu\cos + \sin\theta)}$$

The magnitude of the hysteresis force relative to the spring force can be tailored by the values of the hysteresis link parameters $X_3$, $x_4$, and $y_1$.

For the case of upward pedal travel, the force applied to the pedal beam by the hysteresis link can be expressed as:

$$F_{1y} = F_s + \frac{F_s X_3(\sin\theta + \mu\cos\theta)}{x_4(\mu\cos\theta - \sin\theta) - y_1(\cos\theta + \mu\sin\theta)}$$

Yet alternate configurations will come to the mind of those skilled in the art as a result of the teachings of the present invention. Regardless of the exact arrangement, knowing the moment arms and forces, a relationship can be developed for elements of interest when determining a desired value for the hysteresis response of displacement versus force for a selected spring constant and element dimensions.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

That which is claimed is:

1. A pedal comprising:

a base having a surface thereon;

a pedal beam rotatably connected to the base;

an arm member having a medial portion pivotally coupled to the pedal beam, the arm member having a friction surface on a first arm portion for slidably engaging the surface of the base and a second arm portion opposing the first arm portion pivotal about the medial portion; and biasing means operable with the arm member second arm portion for biasing the pedal beam toward a preselected position while simultaneously biasing the friction surface of the arm member first arm portion against the surface of the base, wherein rotating the pedal beam with an applying force to a free end thereof results in a frictional force between the arm member and the base with an increasing displacement of a pedal free end, and wherein reducing the displacement through a retracting force returns the pedal to the preselected position through a hysteresis force response for the pedal beam displacement, the retracting force being less than the applying force by a predetermined amount for a preselected displacement.

2. A pedal according to claim 1, further comprising a boss pivotal within a depression carried by the arm member medial portion for pivotally coupling the arm member to the pedal beam.

3. A pedal according to claim 1, wherein the first arm portion includes a longitudinal axis generally orthogonal to a longitudinal axis of the second arm portion.

4. A pedal according to claim 1, wherein the friction surface of the arm member comprises a convex surface, and wherein the surface of the base engaging the convex surface comprises a concave surface.

5. A pedal according to claim 4, wherein each of the convex and concave surfaces is defined by a radius of curvature centered about an axis of rotation of the pedal beam.

6. A pedal according to claim 1, further comprising a stop carried by the base for limiting rotation of the pedal beam to the preselected position.

7. A pedal according to claim 1, wherein a longitudinal axis of the arm member extends through a pivot point thereof, and wherein the friction surface engages the surface of the base along a friction plane axis oriented at an angle to the longitudinal axis of the arm member.

8. A pedal according to claim 1, wherein the biasing means comprise at least one compression spring.

9. A pedal according to claim 1, wherein the base comprises a mounting bracket.

10. A pedal according to claim 9, further comprising a shaft carried by the mounting bracket, wherein the pedal beam is rotatable about the shaft.

11. A pedal according to claim 10, wherein a proximal end of the pedal beam is connected to the shaft and a distal end comprises a free end having a pedal pad thereon for applying a force thereto for displacing the distal end and rotating the pedal beam about the shaft.

12. A pedal according to claim 1, further comprising a position sensor responsive to rotation of the pedal beam for providing an electrical signal representative of pedal rotation about the rotation axis and thus pedal pad displacement.

13. A pedal useful for operation with a motor vehicle having an electronic throttle control system, the pedal comprising:

a mounting bracket for mounting the pedal to a vehicle wall;

a shaft carried by the bracket;

a pedal beam having a proximal end operable with the shaft and a distal end operable by a user for applying a force thereto for displacement thereof and rotation of the pedal beam about a rotation axis;

a friction block carried by the mounting bracket, the friction block having a first friction surface thereon.

a lever arm operable with the pedal beam, the lever arm having opposing first and second arm members pivotal about a medial portion therebetween, the medial portion pivotally coupled to the pedal beam, wherein the first arm member includes a second friction surface slidably engaging the first friction surface of the friction block; and a compression spring operable between the mounting bracket and the lever arm for biasing the pedal beam toward an idle position through a biasing force on the lever arm, and further biasing the second friction surface against the first friction surface, wherein displacing the pedal beam distal end by applying an applying force thereto compresses the compression spring which increases a frictional force between the first and second friction surfaces with an increasing displacement of the pedal beam distal end, and wherein reducing the displacement through a retracting force on the pedal beam distal end expands the compression spring and returns the pedal beam to the idle position through a hysteresis force response for the pedal beam displacement, the retracting force being less than the applying force for a given displacement.

14. A pedal according to claim 13, further comprising a position sensor responsive to rotation of the pedal beam about the shaft for providing an electrical signal representative of the rotation.

15. A pedal according to claim 13, wherein each of the first and second friction surfaces comprises an arcuate surface.

16. A pedal according to claim 13, wherein the first friction surface comprises a concave surface and the second friction surface comprises a convex surface, and wherein each of the convex and concave surfaces is defined by a radius of curvature centered about the rotation axis of the pedal beam.

17. A pedal according to claim 13, wherein a longitudinal axis of the first arm portion extends through a pivot point thereof, and wherein the second friction surface engages the first surface along a friction plane axis defining an orientation of the first and second friction surfaces at an angle to the longitudinal axis of the first arm portion.

18. A pedal according to claim 13, wherein the first arm member is generally orthogonal to the second arm member, and wherein a medial portion therebetween is pivotally coupled with the pedal beam, and wherein the second arm member is operable with the compression spring for rotating the first arm member about the medial portion for biasing the second friction surface thereof against the first friction surface.

19. A pedal according to claim 18, further comprising a boss extending from the pedal beam and operable with a depression extending within the medial portion for pivotally coupling the lever arm to the pedal beam.

20. A pedal according to claim 18, further comprising a position sensor responsive to a rotation of the pedal beam for providing an electrical signal representative of the pedal rotation about an axis of rotation and thus pedal pad displacement.

21. A method for providing a preselected hysteresis force response during displacement of a pedal, wherein the pedal includes a pedal beam pivotally connected to a base for rotation about a shaft carried by the base, the method comprising:

pivotally coupling an arm member to the pedal beam, the arm member having a friction surface positioned engaging a surface of the base for slidable movement thereon wherein the arm member includes opposing first and second arm portions pivotal about a medial portion therebetween, and wherein the pivotally coupling includes the coupling of the medial portion with the pedal beam, and wherein the first arm portion includes the friction surface; and biasing the pedal beam toward a preselected position through a biasing force on the second arm portion of the arm member, while simultaneously biasing the friction surface of the arm member against the surface of the base, wherein rotating the pedal beam with an applying force to a free end of the pedal beam creates a frictional force between the arm member and the base with an increasing displacement of a pedal beam free end, and wherein reducing the displacement through a retracting force returns the pedal to the preselected position through a hysteresis force response for the pedal beam displacement, the retracting force being less than the applying force by a predetermined amount for a preselected displacement.

22. A method according to claim 21, wherein the first arm portion includes a longitudinal axis generally orthogonal to a longitudinal axis of the second arm portion.

23. A method according to claim 22, further comprising providing the first and second arm portions having preselected length dimensions for providing a preselected biasing of the friction surface of the arm member against the surface of the base.

24. A method according to claim 21, wherein a longitudinal axis of the arm member extends through a pivot point thereof, and wherein the friction surface engages the surface of the base along a friction plane axis oriented at an angle to the longitudinal axis of the arm member, and wherein the method comprises orienting the friction plane axis at a preselected orientation.

25. A method according to claim 21, further comprising sensing rotation of the pedal beam for providing an electrical signal representative of pedal rotation about the rotation axis and thus pedal pad displacement.

26. A pedal comprising:

a base having a surface thereon;

a pedal beam connected to the base for movement about an axis of rotation;

an arm member pivotally coupled to the pedal beam, the arm member having a friction surface positioned engaging a surface of the base for slidable movement thereon, wherein the friction surface of the arm member includes a convex shaped surface and the surface of the base engaging the convex shaped surface includes a concave surface, and wherein each of the convex and concave surfaces is defined by a radius of curvature centered about the axis of rotation of the pedal beam; and biasing means operable with the pedal beam and arm member for biasing the pedal beam toward a preselected position through a biasing force on the arm member, while simultaneously biasing the friction surface of the arm member against the surface of the base, wherein rotating the pedal beam with an applying force to a free end of the pedal beam creates a frictional force between the arm member and the base with an increasing displacement of a pedal free end, and wherein reducing the displacement through a retracting force returns the pedal to the preselected position through a hysteresis force response for the pedal beam displacement, the retracting force being less than the applying force by a predetermined amount for a preselected displacement.

27. A pedal comprising:

a base;

a friction block carried by the base, the friction block having an arcuate surface thereon;

a pedal beam rotatably connected to the base;

an arm member having first and second arm portions and a medial portion therebetween, the arm member medial portion pivotally coupled to the pedal beam, the arm member first arm portion having a friction surface positioned for engaging the arcuate surface of the friction block for slidable movement thereon; and biasing means operable with the arm member second arm portion for biasing the pedal beam toward a preselected position through a biasing force thereon, while simultaneously biasing the friction surface of the arm member first arm portion against the friction block, wherein rotating the pedal beam with an applying force to a free end thereof results in a frictional force between the arm member and the friction block with an increasing displacement of a pedal free end, and wherein reducing the displacement through a retracting force returns the pedal to the preselected position through a hysteresis force response for the pedal beam displacement, the retracting force being less than the applying force by a predetermined amount for a preselected displacement.

* * * * *